US009761927B2

(12) United States Patent
Kasar et al.

(10) Patent No.: US 9,761,927 B2
(45) Date of Patent: Sep. 12, 2017

(54) BATTERY CASE WITH SUPPLEMENTAL ANTENNA FEATURES FOR CELLULAR TELEPHONE

(71) Applicant: Apple Inc., Cupertino, CA (US)

(72) Inventors: Darshan R. Kasar, San Francisco, CA (US); Kirill Kalinichev, San Francisco, CA (US); Ian P. Colahan, Menlo Park, CA (US); Timothy J. Rasmussen, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 88 days.

(21) Appl. No.: 14/848,034

(22) Filed: Sep. 8, 2015

(65) Prior Publication Data

US 2017/0069955 A1 Mar. 9, 2017

(51) Int. Cl.

| | |
|---|---|
| ***H01Q 1/24*** | (2006.01) |
| ***H01Q 9/04*** | (2006.01) |
| ***H01Q 1/40*** | (2006.01) |
| ***H01Q 1/42*** | (2006.01) |

(52) U.S. Cl.

CPC ..... *H01Q 1/243* (2013.01); *H01Q 1/40* (2013.01); *H01Q 1/42* (2013.01); *H01Q 9/0442* (2013.01)

(58) Field of Classification Search

CPC .. H01Q 1/40; H01Q 1/42; H01Q 1/24; H01Q 1/241; H01Q 1/242; H01Q 1/243; H04M 1/0237; H04M 1/0264; H04M 1/0272; H04M 1/0283; H04M 1/03; H04M 1/21; H04M 1/72522

See application file for complete search history.

(56) References Cited

U.S. PATENT DOCUMENTS

| | | | | |
|---|---|---|---|---|
| 8,565,843 | B1 * | 10/2013 | Lugo | H04M 1/04 455/556.1 |
| 8,646,698 | B2 | 2/2014 | Chen et al. | |
| 8,774,716 | B2 * | 7/2014 | Chan | H04B 5/0062 235/492 |
| 8,954,122 | B2 | 2/2015 | Wilmhoff et al. | |
| 9,124,677 | B2 | 9/2015 | Wenger et al. | |

(Continued)

FOREIGN PATENT DOCUMENTS

| | | |
|---|---|---|
| CN | 201976377 U | 9/2011 |
| CN | 202111753 U | 1/2012 |

(Continued)

OTHER PUBLICATIONS

Hu et al., U.S. Appl. No. 14/477,596, filed Sep. 4, 2014.

*Primary Examiner* — Hoang Nguyen

(74) *Attorney, Agent, or Firm* — Treyz Law Group, P.C.; G. Victor Treyz; Zachary D. Hadd

(57) ABSTRACT

A removable case may receive an electronic device. A male connector in the case may mate with a female connector in the device. A battery in the case may supply power to the device through the male connector. The electronic device may have an antenna. The case may have a supplemental antenna that compensates for variations in performance in the antenna when the device is received within the case. The supplemental antenna may be a parasitic antenna resonating element that is formed from metal traces on a flexible printed circuit. The flexible printed circuit, a metal trim structure, and a plastic support structure may form portions of a connector support structure in the case.

20 Claims, 6 Drawing Sheets

(56) References Cited

U.S. PATENT DOCUMENTS

| | | | | |
|---|---|---|---|---|
| 2011/0016494 | A1* | 1/2011 | Linhardt | H04N 21/41407 725/62 |
| 2012/0056789 | A1 | 3/2012 | Sohn | |
| 2015/0172431 | A1 | 6/2015 | Huang | |
| 2015/0194997 | A1 | 7/2015 | Johnson et al. | |
| 2015/0222008 | A1 | 8/2015 | Cooper | |
| 2015/0326702 | A1* | 11/2015 | Ames | H04M 1/03 455/556.1 |

FOREIGN PATENT DOCUMENTS

| | | | |
|---|---|---|---|
| CN | 202504476 | U | 10/2012 |
| CN | 103330361 | A | 10/2013 |
| CN | 203289499 | U | 11/2013 |
| CN | 104301463 | A | 1/2015 |
| CN | 104661556 | A | 5/2015 |
| WO | 2008143452 | | 11/2008 |
| WO | 2015/066601 | A1 | 5/2015 |

* cited by examiner

BATTERY CASE WITH SUPPLEMENTAL ANTENNA FEATURES FOR CELLULAR TELEPHONE

BACKGROUND

This relates generally to removable cases for electronic devices and, more particularly, to removable cases for wireless electronic devices.

Electronic devices often include wireless circuitry. For example, cellular telephones, computers, and other devices often contain antennas for supporting wireless communications with external equipment. Removable cases are sometimes used with electronic devices. Some cases are passive plastic sleeves that help protect the outer surface of an electronic device from scratches. Other cases contain supplemental batteries. When a case with a supplemental battery is attached to an electronic device, a user can perform more functions without running out of battery power.

It can be challenging to ensure that an electronic device antenna operates properly in the presence of an external case. The materials of the case may affect antenna operation. For example, metal structures associated with a battery of other components may interfere with the normal operation of an electronic device antenna and dielectric materials may load an antenna. If care is not taken, wireless performance for an electronic device may be degraded in the presence of a removable case or undesired amounts of radiated spurious emissions may arise.

It would therefore be desirable to be able to provide improved removable cases for electronic devices such as electronic devices with antennas.

SUMMARY

A removable case for an electronic device such as a cellular telephone may have a body. A male connector in the case may mate with a female connector in the electronic device. The male connector may be supported by a connector support structure located at one of the ends of the body. The connector support structure and the body may be configured to receive the electronic device.

A battery in the case may supply power to the electronic device through the male connector. The battery power supplied to the device through the male connector may supplement internal battery power in the electronic device.

The electronic device may have an antenna. Due to the presence of external structures such as portions of the case, there is a potential for the antenna of the electronic device to become detuned when the electronic device is received within the body of the case. A supplemental antenna in the case may be used to restore antenna performance to the electronic device, so that the electronic device antenna performs satisfactorily, even when the electronic device is received within the body of the case. The supplemental antenna and other features in the case may be configured to help reduce or eliminate radiated spurious emissions.

The supplemental antenna may be formed from an antenna resonating element on a flexible printed circuit that is coupled to the connector support structure.

DETAILED DESCRIPTION

Figure 1:
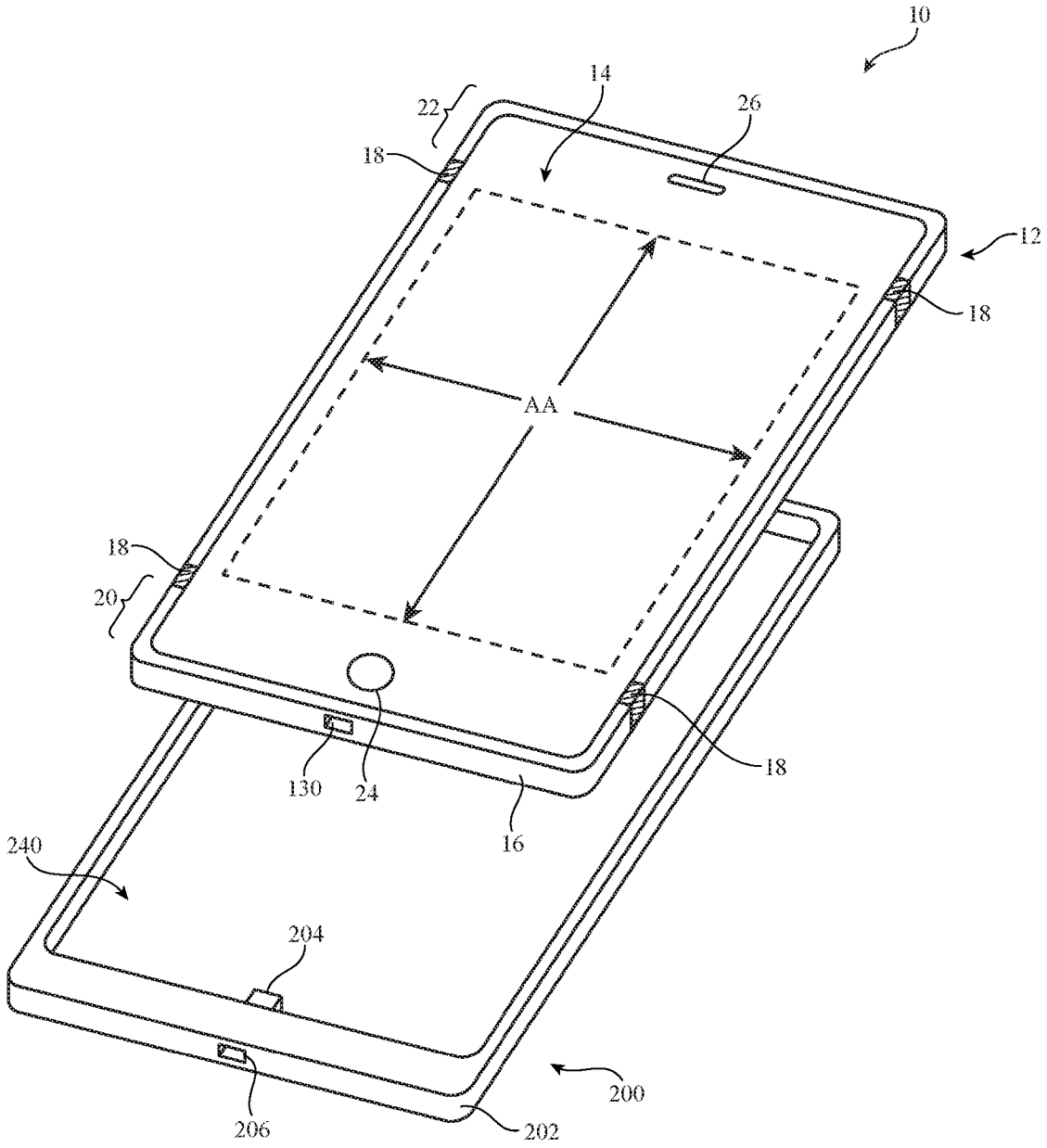
FIG. 1 is a perspective view of an illustrative electronic device and a mating removable case in accordance with an embodiment.

Electronic devices may be provided with removable external cases. The removable external cases may contain supplemental components. For example, a removable electronic device case may include a supplemental battery to extend battery life. An illustrative electronic device and a mating removable case are shown in the exploded perspective view of FIG. 1. As shown in FIG. 1, electronic device 10 may have a rectangular shape and case 200 may have a body such as body 202 with a corresponding rectangular recess. Rectangular recess 240 of body 202 may be configured to receive a rectangular device such as electronic device 10 of FIG. 1. Electronic devices and cases of other shapes may be used, if desired. For example, a case may have a folding cover, may have the shape of a sleeve that slides over an electronic device, may be mounted to only one end of an electronic device, or may have other suitable shapes. The example of FIG. 1 is merely illustrative.

Device 10 may include one or more antennas such as loop antennas, inverted-F antennas, strip antennas, planar inverted-F antennas, slot antennas, hybrid antennas that include antenna structures of more than one type, or other suitable antennas. Conductive structures for the antennas may, if desired, be formed from conductive electronic device structures. The conductive electronic device structures may include conductive housing structures and internal structures (e.g., brackets, metal members that are formed using techniques such as stamping, machining, laser cutting, etc.), and other conductive electronic device structures. The housing structures may include peripheral structures such as peripheral conductive structures that run around the periphery of an electronic device. The peripheral conductive structure may serve as a bezel for a planar structure such as a display, may serve as sidewall structures for a device housing, may have portions that extend upwards from an integral planar rear housing (e.g., to form vertical planar sidewalls or curved sidewalls), and/or may form other housing structures. Gaps may be formed in the peripheral conductive structures that divide the peripheral conductive structures into peripheral segments. One or more of the segments may be used in forming one or more antennas for electronic device 10. Antennas may also be formed using an antenna ground plane formed from conductive housing structures such as metal housing midplate structures and other internal device structures. Rear housing wall structures may be used in forming antenna structures such as an antenna ground.

Electronic device 10 may be a portable electronic device or other suitable electronic device. For example, electronic device 10 may be a laptop computer, a tablet computer, a somewhat smaller device such as a wristwatch device, pendant device, headphone device, earpiece device, or other wearable or miniature device, a handheld device such as a cellular telephone, a media player, an electronic stylus, or other small portable device. Device 10 may also be a television, a set-top box, a desktop computer, a computer monitor into which a computer has been integrated, or other suitable electronic equipment.

Device 10 may include a housing such as housing 12. Housing 12 may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

The rear face of housing 12 may have a planar housing wall. The rear housing wall may be formed from metal with one or more regions that are filled with plastic or other dielectric. Portions of the rear housing wall that are separated by dielectric in this way may be coupled together using conductive structures (e.g., internal conductive structures) and/or may be electrically isolated from each other.

Device 10 may, if desired, have a display such as display 14. Display 14 may be mounted on the opposing front face of device 10 from the rear housing wall. Display 14 may be a touch screen that incorporates capacitive touch electrodes or may be insensitive to touch.

Display 14 may include image pixels formed from light-emitting diodes (LEDs), organic LEDs (OLEDs), plasma cells, electrowetting pixels, electrophoretic pixels, liquid crystal display (LCD) components, or other suitable image pixel structures. A display cover layer such as a layer of clear glass or plastic, a layer of sapphire, a transparent dielectric such as clear ceramic, fused silica, transparent crystalline material, or other materials or combinations of these materials may cover the surface of display 14. Buttons such as button 24 may pass through openings in the cover layer. The cover layer may also have other openings such as an opening for speaker port 26.

Housing 12 may include peripheral housing structures such as structures 16. Structures 16 may run around the periphery of device 10 and display 14. In configurations in which device 10 and display 14 have a rectangular shape with four edges, structures 16 may be implemented using peripheral housing structures that have a rectangular ring shape with four corresponding edges (as an example). Peripheral structures 16 or part of peripheral structures 16 may serve as a bezel for display 14 (e.g., a cosmetic trim that surrounds all four sides of display 14 and/or that helps hold display 14 to device 10). Peripheral structures 16 may also, if desired, form sidewall structures for device 10 (e.g., by forming a metal band with vertical sidewalls, by forming curved sidewalls that extend upwards as integral portions of a rear housing wall, etc.).

Peripheral housing structures 16 may be formed of a conductive material such as metal and may therefore sometimes be referred to as peripheral conductive housing structures, conductive housing structures, peripheral metal structures, or a peripheral conductive housing member (as examples). Peripheral housing structures 16 may be formed from a metal such as stainless steel, aluminum, or other suitable materials. One, two, or more than two separate structures may be used in forming peripheral housing structures 16.

If desired, housing 12 may have a conductive rear surface. For example, housing 12 may be formed from a metal such as stainless steel or aluminum. The rear surface of housing 12 may lie in a plane that is parallel to display 14. In configurations for device 10 in which the rear surface of housing 12 is formed from metal, it may be desirable to form parts of peripheral conductive housing structures 16 as integral portions of the housing structures forming the rear surface of housing 12. For example, a rear housing wall of device 10 may be formed from a planar metal structure and portions of peripheral housing structures 16 on the sides of housing 12 may be formed as vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions.

Display 14 may include conductive structures such as an array of capacitive electrodes, conductive lines for addressing pixel elements, driver circuits, etc. Housing 12 may include internal structures such as metal frame members, a planar housing member (sometimes referred to as a midplate) that spans the walls of housing 12 (i.e., a substantially rectangular sheet formed from one or more parts that is welded or otherwise connected between opposing sides of member 16), printed circuit boards, and other internal conductive structures. These conductive structures, which may be used in forming a ground plane in device 10, may be located in the center of housing 12 under active area AA of display 14 (e.g., the portion of display 14 that contains a display module for displaying images).

In regions such as regions 22 and 20, openings may be formed within the conductive structures of device 10 (e.g., between peripheral conductive housing structures 16 and opposing conductive ground structures such as conductive housing midplate or rear housing wall structures, a printed circuit board, and conductive electrical components in display 14 and device 10). These openings, which may sometimes be referred to as gaps, may be filled with air and/or solid dielectrics such as plastic, glass, ceramic, polymers with fiber filler material (e.g., fiber composites), sapphire, etc.

Conductive housing structures and other conductive structures in device 10 such as a midplate, traces on a printed circuit board, display 14, and conductive electronic components may serve as a ground plane for the antennas in device 10. The openings in regions 20 and 22 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 20 and 22. If desired, the ground plane that is under active area AA of display 14 and/or other metal structures in device 10 may have portions that extend into parts of the ends of device 10 (e.g., the ground may extend towards the dielectric-filled openings in regions 20 and 22).

In general, device 10 may include any suitable number of antennas (e.g., one or more, two or more, three or more, four or more, etc.). The antennas in device 10 may be located at opposing first and second ends of an elongated device housing (e.g., at ends 20 and 22 of device 10 of FIG. 1), along one or more edges of a device housing, in the center of a device housing, in other suitable locations, or in one or more of these locations. The arrangement of FIG. 1 is merely illustrative.

Portions of peripheral housing structures 16 may be provided with gap structures. For example, peripheral housing structures 16 may be provided with one or more peripheral gaps such as gaps 18, as shown in FIG. 1. The gaps in peripheral housing structures 16 may be filled with dielectric such as polymer, ceramic, glass, air, other dielectric materials, or combinations of these materials. Gaps 18 may divide peripheral housing structures 16 into one or more peripheral conductive segments. There may be, for example, two peripheral conductive segments in peripheral housing structures 16 (e.g., in an arrangement with two gaps), three peripheral conductive segments (e.g., in an arrangement with three gaps), four peripheral conductive segments (e.g., in an arrangement with four gaps, etc.). The segments of peripheral conductive housing structures 16 that are formed in this way may form parts of antennas in device 10 (e.g., a resonating element arm in an inverted-F antenna and/or part of the periphery of a slot antenna, etc.). If desired, gaps may extend across the width of the rear wall of housing 12 and may penetrate through the rear wall of housing 12 to divide the rear wall into different portions. Polymer or other dielectric may fill these housing gaps (grooves).

In a typical scenario, device 10 may have upper and lower antennas (as an example). An upper antenna may, for example, be formed at the upper end of device 10 in region 22. A lower antenna may, for example, be formed at the lower end of device 10 in region 20. The antennas may be used separately to cover identical communications bands, overlapping communications bands, or separate communications bands. The antennas may be used to implement an antenna diversity scheme or a multiple-input-multiple-output (MIMO) antenna scheme.

Antennas in device 10 may be used to support any communications bands of interest. For example, device 10 may include antenna structures for supporting local area network communications, voice and data cellular telephone communications, global positioning system (GPS) communications or other satellite navigation system communications, Bluetooth® communications, etc.

Case 200 may have a body such as body 202. Body 202 may be formed from plastic and/or other materials. For example, body 202 of case 200 may be formed from injection molded plastic. Other insulating and/or conductive materials may be used in forming body structures such as body 202 if desired. Rectangular recess 240 may be shaped to receive electronic device 10. If desired, other shapes may be formed in body 202 to receive device 10. The configuration of FIG. 1 is illustrative.

A battery and other components may be mounted within body 202 of case 200. Device 10 may have a connector port with a connector such as female connector 130. Connector 130 may have signal pins and power pins (sometimes referred to as contacts, signal paths, or signal lines). For example, connector 130 may have 5-20 contacts, 16 contacts, 8 contacts, more than 3 contacts, or fewer than 32 contacts. Case 200 may have a mating connector such as male connector 204. When device 10 is mounted in case 200, connector 204 and connector 130 may be coupled to each other (i.e., the contacts of connector 204 may mate with corresponding contacts in connector 130). The battery in case 200 may supply supplemental power to device 10 by routing power signals to the circuitry of device 10 through power pins in connectors 204 and 130.

Connector 204 may be coupled to female connector 206. When it is desired to use an accessory or other external equipment with device 10, an external plug (e.g., a plug on the end of an accessory cable or a plug in a dock) may be inserted into connector 206. Internal wiring in case 200 may route signals from contacts in the plug coupled to connector 206 to corresponding contacts in connector 204. Because connector 204 is coupled to connector 130, this routes the signals from the accessory or other external equipment to device 10 (i.e., plugs 204 and 206 serve as a port replicator).

Figure 2:
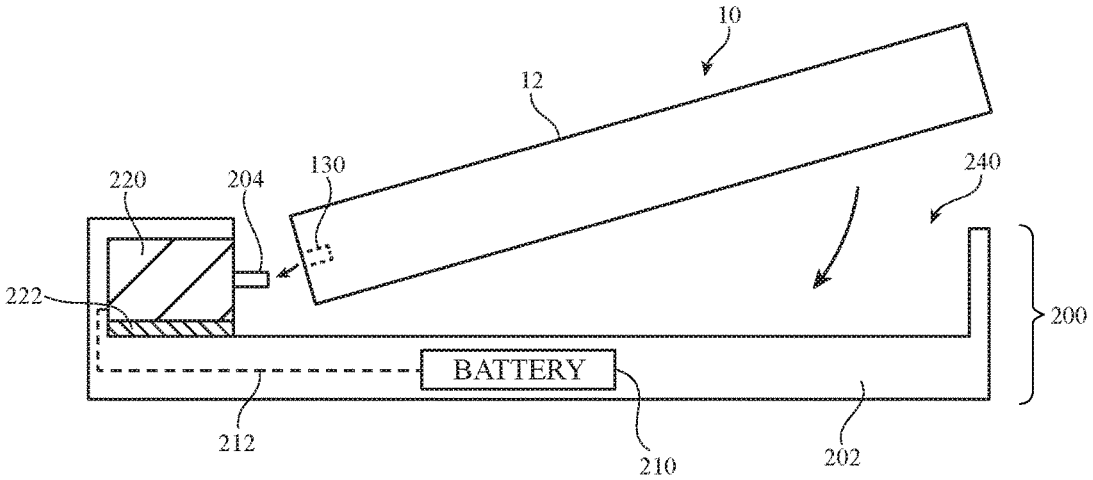
FIG. 2 is a cross-sectional side view of an illustrative electronic device and a mating case with a supplemental antenna in accordance with an embodiment.

A cross-sectional side view of device 10 and case 200 is shown in FIG. 2. In the illustrative configuration of FIG. 2, device 10 is shown in a configuration in which housing 12 of device 10 has been partly inserted into recess 240 of body 202 of case 200. In this configuration, connector 204 of case 200 is positioned for insertion into connector 130. Device 10 may be powered by an internal power source such as a battery. External power may also be supplied to device 10 through connector 130. For example, power may be received from battery 210 in case 200 via path 212 and connector 204 when device 10 has been mounted in case 200 so that connector 204 mates with connector 130.

Connector 204 and other circuitry in case 200 may be mounted in a connector support structure (sometimes referred to as a chin structure) such as structure 220 at the end of case body 202. Chin structure 220 may include a hollow plastic structure that receives the end of housing 12 of device 10. A structure such as flexible printed circuit 222 or other structure may be included on the lower portion of chin structure 220. Flexible printed circuit 222 may include a metal trace that forms a supplemental antenna element.

The supplemental antenna element may be coupled to the antenna in device 10 via near-field coupling and/or by coupling portions of the antenna in device 10 (e.g., an antenna ground) to portion of the supplemental antenna element (e.g., via a signal path in connectors 204 and 130, etc.).

In the absence of the supplemental antenna element, there may be a risk that an antenna in device 10 (e.g., an antenna at lower end 20 of device 10) may be detuned when device 10 is installed in body 202 of case 200. The supplemental antenna element may be coupled to the antenna of device 10 (e.g., through a signal path in connectors 130 and 204 or other suitable path and/or via near-field electromagnetic coupling) and may be used to restore a desired level of antenna performance and reduce or eliminate radiated spurious emissions when device 10 is installed in case 200. If desired, the supplemental antenna element may include tunable circuitry that can be adjusted using control circuitry in case 200 and/or control circuitry in device 10.

Figure 3:
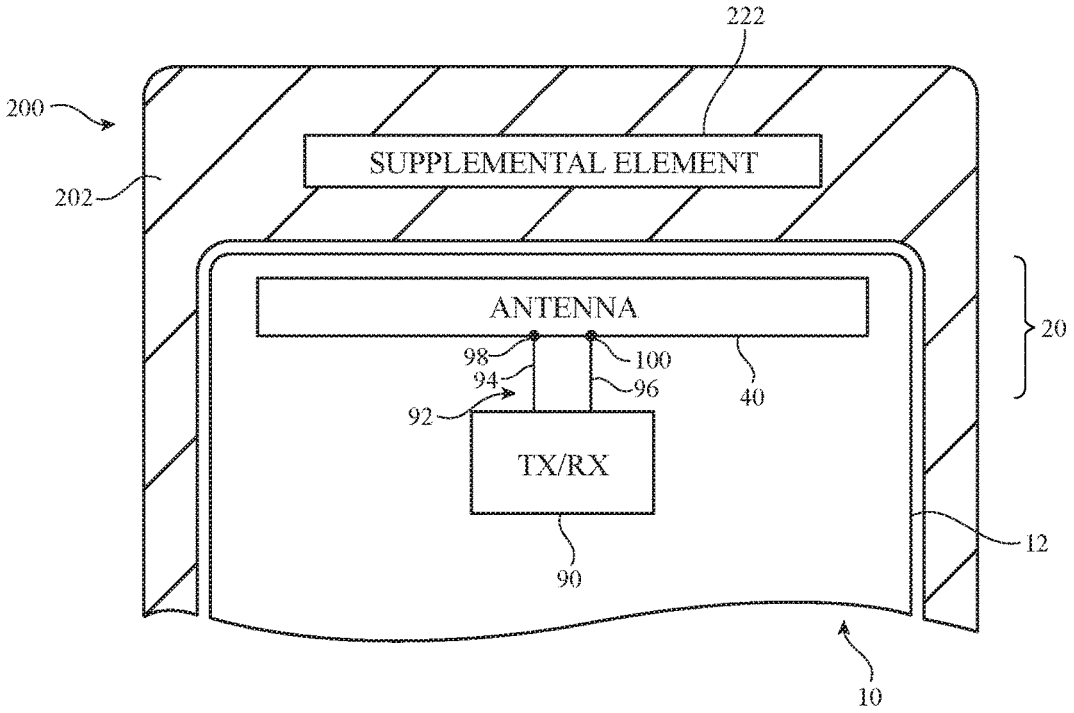
FIG. 3 is a top view of an illustrative electronic device and a mating case with a supplemental antenna in accordance with an embodiment.

FIG. 3 is a top view of a portion of case 200 and device 10 at lower end 20 of device 10. As shown in FIG. 3, device 10 may include radio-frequency transceiver circuitry 90 for handling various radio-frequency communications bands. For example, circuitry 90 may include transceiver circuitry that handles 2.4 GHz and 5 GHz bands for WiFi® (IEEE 802.11) communications and may handle the 2.4 GHz Bluetooth® communications band, cellular telephone transceiver circuitry for handling wireless communications in frequency ranges such as a low communications band from 700 to 960 MHz, a midband from 1710 to 2170 MHz, and a high band from 2300 to 2700 MHz or other communications bands between 700 MHz and 2700 MHz or other suitable frequencies (as examples), and/or circuitry for handling wireless communications at other frequencies.

Radio-frequency transceiver circuitry 90 may be coupled to antenna 40 using a signal path such as transmission line 92. Antenna 40 may be formed using any suitable antenna type. For example, antenna 40 may include one or more antennas with resonating elements that are formed from loop antenna structures, patch antenna structures, inverted-F antenna structures, slot antenna structures, planar inverted-F antenna structures, helical antenna structures, hybrids of these designs, etc. Different types of antennas may be used for different bands and combinations of bands. For example, antenna 40 may include antenna structures for one type of antenna for forming a local wireless link antenna such as a wireless local area network link and may include antenna structures for another type of antenna for forming a remote wireless link antenna (e.g., a cellular telephone antenna).

Case 200 may have a supplemental antenna structure such as supplemental antenna element 222. Element 222 may help ensure that device 10 operates properly, even in the presence of the structures of case 200.

Transmission line 92 may include positive signal line (path) 94 and ground signal line (path) 96. Transmission line 92 may be coupled to an antenna feed for antenna 40 that is formed from positive antenna feed terminal 98 and ground antenna feed terminal 100. Positive signal line 94 may be coupled to positive antenna feed terminal 98 and ground signal line 96 may be coupled to ground antenna feed terminal 100. If desired, impedance matching circuitry, switching circuitry, filter circuitry, and other circuits may be interposed in the path between transceiver circuitry 90 and antenna 40.

Figure 4:
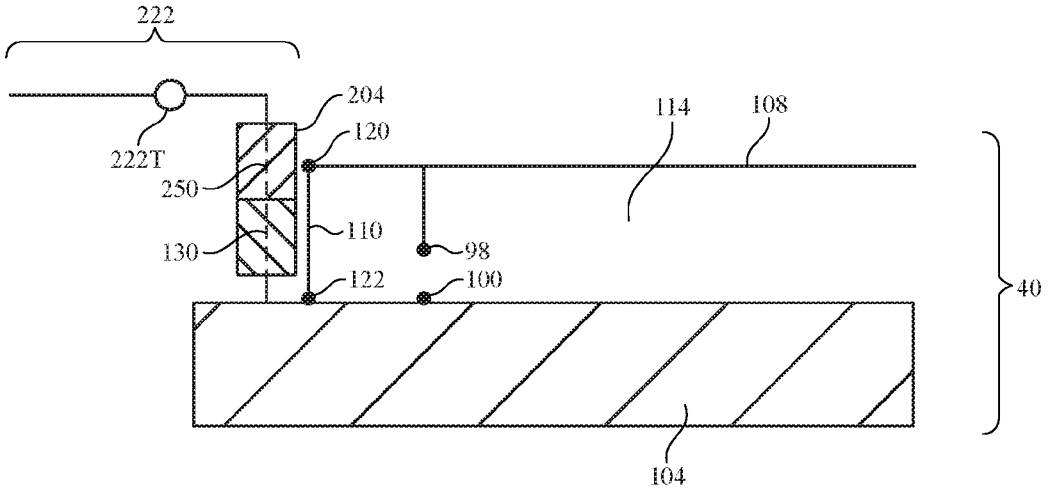
FIG. 4 is a schematic diagram of an illustrative electronic device antenna and a supplemental antenna element in a case in accordance with an embodiment.

FIG. 4 shows an illustrative antenna for device 10 and an illustrative associated supplemental antenna element for case 200. In the example of FIG. 4, antenna 40 is an inverted-F antenna. This is merely illustrative. Antenna 40 may be an inverted-F antenna, a slot antenna, an antenna that includes slot and inverted-F structures, etc.

As shown in FIG. 4, antenna 40 may include inverted-F antenna resonating element 108 and antenna ground 104. Ground 104 may be formed from metal portions of housing 12 (e.g., portions of the rear wall of housing 12, a housing midplate, etc.), conductive structures such as display components and other electrical components, ground traces in printed circuits, etc. For example, ground 104 may include portions that are formed from metal housing walls, a metal band or bezel, or other peripheral conductive housing structures.

Antenna resonating element 108 may be formed from peripheral conductive housing structure in device 10 (e.g., a segment of structures 16 of FIG. 1) or other conductive structures. Structure 108 may form a main resonating element arm for the inverted-F antenna resonating element and may have one or more branches (e.g., branches that are terminated at gaps 18 at the ends of a segment of structures 16, etc.).

Dielectric 114 may form a gap that separates structure 108 from ground 104. The shape of the dielectric gap associated with dielectric 114 may form a slot antenna resonating element (i.e., the conductive structures surrounding dielectric 114 may form a slot antenna). The slot antenna resonating element may support an antenna resonance at higher frequencies (e.g., a high band resonance). Higher frequency antenna performance may also be supported by harmonics of the lower-frequency resonances associated with longer and shorter branches of structure 108.

One or more electrical components may span dielectric gap 114. These components may include resistors, capacitors, inductors, switches and other structures to provide tuning capabilities, etc. Components in antenna 40 may be used to tune the performance of antenna 40 dynamically during antenna operation and/or may include fixed components.

Antenna 40 may have a return path (sometimes referred to as a short circuit path or short pin) such as return path 110. Return path 110 may be coupled between the main inverted-F resonating element arm formed from structure 108 and antenna ground 104 in parallel with the antenna feed formed by feed terminals 98 and 100. Return path 110 may be formed from a metal member having opposing first and second ends. In the example of FIG. 4, return path 110 is formed from a metal structure that has a first end with a terminal 120 coupled to structure 108 of inverted-F antenna resonating element 106 (e.g., on a housing sidewall or other peripheral conductive structure) and has a second end with a terminal 122 coupled to antenna ground 104. Return path 110 may have other shapes and sizes, if desired.

The presence of case 200 may affect the operation of the structures associated with antenna 40. Accordingly, case 200 may be provided with supplemental antenna element 222. Supplemental element 222 may be a parasitic antenna resonating element (e.g., a monopole element, etc.) that helps ensure that antenna 40 operates satisfactorily, regardless of whether or not device 10 is mounted within case 200. If desired, the performance of element 222 may be tuned (e.g., by using switches, tunable inductors, tunable capacitors, and/or other tunable circuitry 222T that is coupled to element 222). Tunable circuitry 222T may, as an example, be a switch that can be opened or closed to tune the length of element 222 and thereby adjust the frequency at which element 222 resonates and/or may otherwise be used to tune an antenna resonance associated with element 222.

Element 222 may be near-field coupled to antenna 40 and/or may be coupled to antenna 40 through a signal path. The signal path may include one or more signal lines such as path 250 in connectors 204 and 130. Signal path 250 may be a ground path, a power path, a data line path, or other signal path.

Element 222 may be a parasitic antenna resonating element that can influence the frequency response of antenna 40 by supplementing the response of antenna 40 where antenna 40 has been detuned due to the presence of case 200. Using tunable circuitry 222T, the performance of element 222 may be adjusted to suit use of case 200 in different regulatory environments. For example, device 10 can detect the location of device 10 (e.g., by communicating with a wireless network, using global positioning system information, etc.). This location can be conveyed to coupled control circuitry in case 200 and used by the control circuitry in case 200 and/or control circuitry in device 10 to make location-sensitive adjustments to circuitry 222T. Circuit 222T may, as an example, be used to tune element 222 (and therefore antenna 40) to a first state when case 200 is being used in a first geographical location and may be used to tune element 222 (and therefore antenna 40) to a second state when case 200 is being used in a second geographical location. As shown in FIG. 4, element 222 may be coupled to antenna 40 by using path 250 to couple element 222 to ground 104 or other portion of antenna 40. Path 250 may be a connector path formed from paths in connectors 204 and 130 and may be used in addition to or instead of using near-field coupling to couple element 222 to antenna 40.

Figure 5:
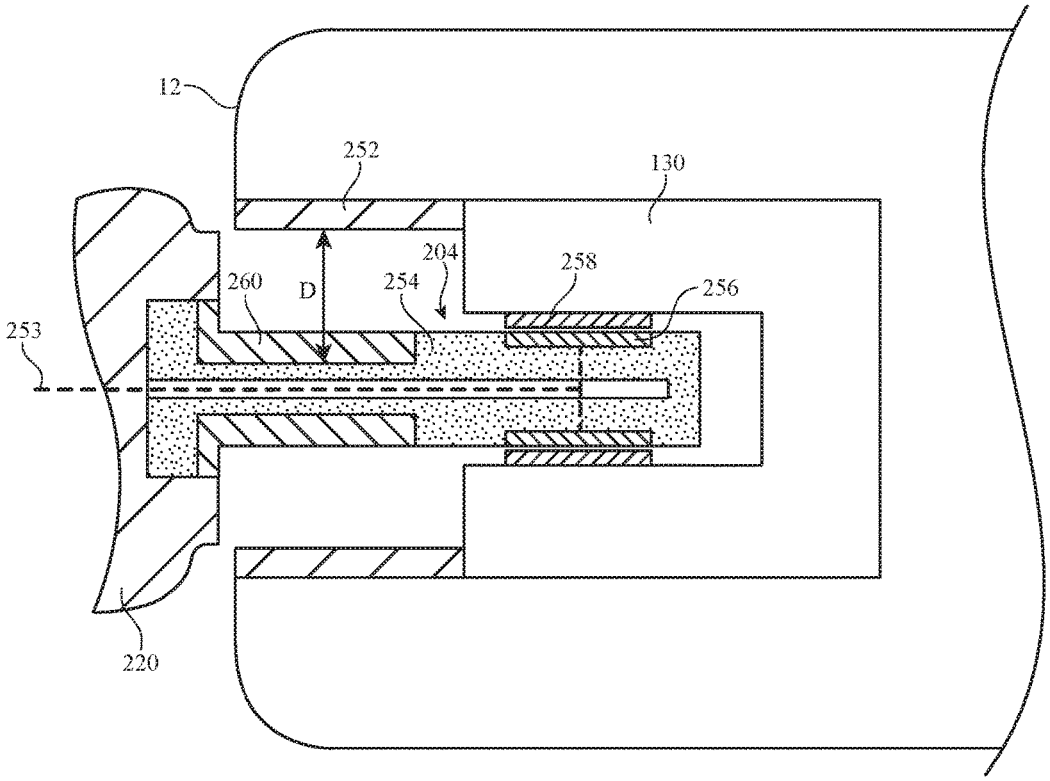
FIG. 5 is a cross-sectional side view of an illustrative electronic device into which a plug from a mating case has been inserted in accordance with an embodiment.

A cross-sectional side view of device 10 mounted in case 200 is shown in FIG. 5. As shown in FIG. 5, case 200 includes plastic enclosure (body) 202 from which connector 204 protrudes. Device 10 may have a metal trim structure such as metal trim ring 252 that surrounds the connector port opening in housing 12. Connector 204 has a protruding support member such as tongue member 254 that is formed from a material such as metal. When connector 204 is mated with connector 130 in device 10, contacts 256 on connector 204 (i.e., contacts 256 on embedded flexible printed circuit 253) mate with corresponding contacts 258 on connector 130.

When connector 204 is inserted in connector 130 as shown in FIG. 5, there is a risk of capacitive coupling between trim member 252 and conductive structures in connector 204 such as support member 254. Member 254 may be formed from machined metal or may be a conductive metal part formed using metal injection molding techniques (e.g., techniques in which powered metal mixed with binder is molded in a mold die to form a conductive part in a desired shape). To increase the distance D between these conductive structures and thereby reduce capacitive coupling, a recessed portion may be formed in support member 254 at a location on support member 254 that lies between connector pins 256 and connector support structure 220. This recessed portion may be filled with plastic 260 or other dielectric. Plastic 260 may be nylon (e.g., a polyamide), a silicone-based polymer, polyurethane, or other suitable polymer. The recessed portion in member 254 may be, for example, a groove that runs along the exposed upper and lower faces of member 254. The presence of dielectric 260 in the recessed portion of tongue member 254 helps reduce capacitive coupling between trim member 252 and member 254 that may otherwise reduce wireless bandwidth.

Figure 6:
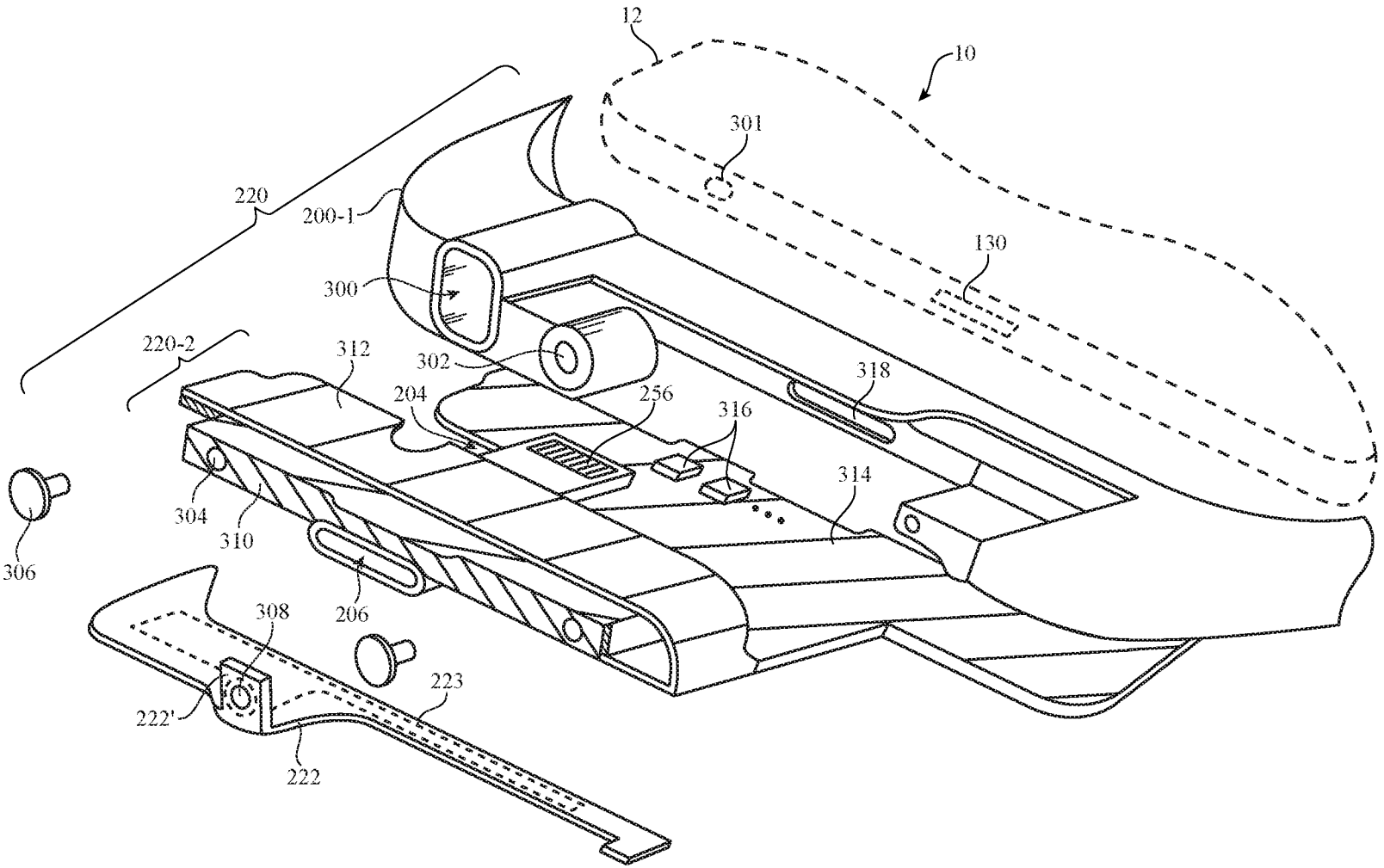
FIG. 6 is an exploded perspective view of components in an illustrative case in accordance with an embodiment.

A perspective view of illustrative structures of the type that may be used in forming chin structure 220 is shown in the exploded perspective view of FIG. 6. As shown in FIG. 6, chin structures 220 may include chin structures such as chin structure 220-1. Chin structures 220-1 may be formed from plastic (e.g., one or more shots of injection molded plastic) and/or other materials. Structure 220-1 may have a hollow portion that is configured to receive the end of housing 12 of device 10. Openings may be formed in structure 220-1 to accommodate speaker ports, connectors, audio jacks, etc. For example, opening 300 may be used to allow an audio jack connector from an external set of headphones (earbuds, etc.) to be plugged into audio port 301 in device 10 when device 10 is installed in case 200 and audio port 301 is aligned with opening 300. When device 10 is installed in case 200, connector 130 of device 10 will be aligned with opening 318 in chin structure 220-1 (or other suitable case body structures). Connector 204 may pass through opening 318 and may be received within connector 130.

Chin structure 220 may include one or more printed circuits. The printed circuits may be rigid printed circuits (e.g., printed circuits formed from rigid printed circuit board material such as fiberglass-filled epoxy) and/or may be flexible printed circuits (e.g., printed circuits formed from flexible polymer substrate materials such as sheets of polyimide or other flexible polymer layers). In the example of FIG. 6, chin structure 220 has flexible printed circuit 314 on which circuitry 316 such as discrete components and integrated circuits may be mounted (e.g., tunable component 222T, control circuitry that adjusts tunable component 222T to tune supplemental antenna element 222 based on location information signals, control signals, or other signals received from device 10 via connectors 130 and 204, power management circuitry, etc.). Chin structure 220 also has flexible printed circuit 312, which is coupled to connector 204. Flexible printed circuits 312 and 314 may be formed from a common substrate or may be formed from separate substrates that are joined using hot bar soldering techniques, connectors, conductive adhesive, welds, or other coupling techniques. Flexible printed circuit 222 may contain metal traces 223 for forming a supplemental antenna element and may, if desired, be coupled to a signal path in connector 204 (see, e.g., signal path 250 of FIG. 4). The length of metal traces 223 (i.e., the length of the supplemental antenna element) may be selected to reduce undesired spurious radiated emissions and restore a desired level of antenna performance when device 10 is installed in case 200. The length of traces 223, the way in which traces 223 are interconnected to ground and/or other signal paths, and other attributes of flexible printed circuit 222 and case 200 may be the same for all cases 200 or cases 200 may have traces of different lengths and other customized features to accommodate different regulations in different parts of the world.

Metal structures may be included in chin structures 220. For example, a metal bracket may be coupled to member 254 of connector 204 and this metal bracket may be attached to structure 310 using fasteners such as screws. Printed circuit 312 may be coupled to the metal bracket, to connector 204, and to structure 310 to form chin assembly 220-2. Assembly 220-2 may mate with structure 220-1 to form chin structure 220.

Structure 310 may be formed from stainless steel or other metal and may sometimes be referred to as a metal trim ring structure (e.g., a structure that includes portions that form a trim for the connector port associated with female connector 206). Screws such as screw 306 or other fasteners may be used to mechanically secure trim member 310 and therefore assembly 220-2 to structure 220-1. Screws such as screw 306 or other fasteners may also form electrical pathways in chin structure 220.

The supplemental antenna element in flexible printed circuit 222 may be coupled to metal traces on bent tab (protruding) portion 222' of circuit 222. Portion 222' may have an opening such as opening 308. Screw 306 may pass through opening 304 in trim member 310 and through opening 308 of portion 222' of flexible printed circuit 222. The shaft of screw 306 may be received within threaded opening 302 in chin structure 220-1. Screw 306 may be formed from metal to help short the antenna trace of flexible printed circuit 222 to the ground path in connector 204 (see, e.g., ground path 250 of FIG. 4). With one suitable arrangement, the supplemental antenna formed from the metal trace in flexible printed circuit 222 may be shorted to metal on portion 222' of flexible printed circuit 222. This metal may be shorted to trim ring structure 310 when screw 306 is used to secure assembly 220-2 to structure 220-1. Trim ring structure 310 may be tied to ground path 250 in connector 204 through traces in flexible printed circuit 312 and/or through other metal structures in assembly 220-2 (e.g., through a metal bracket that is laser welded to member 254, etc.).

The foregoing is merely illustrative and various modifications can be made by those skilled in the art without departing from the scope and spirit of the described embodiments. The foregoing embodiments may be implemented individually or in any combination.

What is claimed is:

1. A removable electronic device case that is configured to mate with an electronic device that has an antenna and a connector port, comprising:

a body;

a chin structure mounted at an end of the body, wherein the body and chin structure are configured to receive the electronic device;

a connector that is supported by the chin structure and that mates with the connector port; and a supplemental antenna element mounted on a printed circuit in the chin structure.

2. The removable electronic device case defined in claim 1 wherein the chin structure comprises an assembly that includes the connector and the printed circuit.

3. The removable electronic device case defined in claim 2 wherein the chin structure comprises a plastic structure to which the assembly is attached.

4. The removable electronic device case defined in claim 3 wherein the plastic structure has an opening through which the connector passes.

5. The removable electronic device case defined in claim 4 further comprising at least one fastener that attaches the assembly to the plastic structure.

6. The removable electronic device case defined in claim 5 wherein the printed circuit comprises a metal trace that forms the supplemental antenna element, wherein the fastener comprises a screw, and wherein the metal trace is electrically coupled to the screw.

7. The removable electronic device case defined in claim 6 wherein the assembly comprises a metal trim member that is electrically coupled to the screw.

8. The removable electronic device case defined in claim 6 wherein the connector in the assembly has a signal path that is electrically coupled to the screw.

9. The removable electronic device case defined in claim 6 wherein the printed circuit comprises a flexible printed circuit with a protruding portion having a hole.

10. The removable electronic device case defined in claim 9 wherein the screw passes through the hole and is coupled to a portion of the metal trace on the protruding portion.

11. The removable electronic device case defined in claim 6 wherein the plastic structure has an audio jack opening that is aligned with an audio jack in the electronic device when the electronic device is received with electronic device case.

12. The removable electronic device case defined in claim 1 further comprising a tunable circuit that tunes the supplemental antenna element.

13. The removable electronic device case defined in claim 12 wherein the connector comprises a metal tongue member that is supported by the chin structure and contacts supported by the metal tongue member, wherein the metal tongue member has a recessed portion that is located between the contacts and the chin structure and that is filled with dielectric to reduce capacitive coupling between the connector and the electronic device.

14. A removable electronic device case that is configured to mate with an electronic device that has an antenna and a connector port, comprising:

a body that has first and second ends;

a connector support structure at the first end that is configured to receive an end of the electronic device;

a male connector that is supported by the connector support structure and that is configured to mate with the connector port of the electronic device when the end of the electronic device is received within the connector support structure;

a battery mounted in the body that supplies power to the electronic device via the male connector; and a flexible printed circuit coupled to the connector support structure, wherein the flexible printed circuit includes metal traces that form a parasitic antenna element for the antenna that helps compensate for variations in performance of the antenna when the end of the electronic device is received within the connector support structure.

15. The removable electronic device case defined in claim 14 further comprising tunable circuitry coupled to the parasitic antenna element that tunes the parasitic antenna element.

16. The removable electronic device case defined in claim 15 wherein the connector support structure includes a plastic structure and a metal trim structure coupled to the plastic structure.

17. The removable electronic device case defined in claim 16 wherein the plastic structure comprises an opening through which the male connector passes.

18. The removable electronic device case defined in claim 17 wherein the flexible printed circuit has a bent tab portion that is coupled to the metal trim structure.

19. The removable electronic device case defined in claim 18 wherein the bent tab portion has an opening, wherein the removable electronic device case further comprises a screw that passes through the opening, and wherein the metal trim structure has an opening through which the screw passes.

20. A removable electronic device case that is configured to mate with an electronic device that has an antenna and a connector port, comprising:

a body having first and second ends;

a connector support structure at the first end that is configured to receive an end of the electronic device, wherein the connector support structure has a plastic structure with an opening and has a metal trim structure with an opening;

a male connector that is supported by the connector support structure, that passes through the opening in the plastic structure, and that is configured to mate with the connector port of the electronic device when the end of the electronic device is received within the connector support structure;

a female connector coupled to the male connector;

a battery mounted in the body that supplies power to the electronic device via the male connector;

a flexible printed circuit coupled to the connector support structure, wherein the flexible printed circuit forms a parasitic antenna element that helps compensate for variations in performance of the antenna when the end of the electronic device is received within the connector support structure and wherein the flexible printed circuit includes an opening; and a fastener that passes through the opening in the flexible printed circuit and that passes through the opening in the metal trim structure.

* * * * *